US008273215B2

(12) United States Patent
Yabe et al.

(10) Patent No.: US 8,273,215 B2
(45) Date of Patent: Sep. 25, 2012

(54) METHOD FOR PRODUCING COATED PAPER

(75) Inventors: Kenichiro Yabe, Wakayama (JP); Yasushi Ikeda, Wakayama (JP); Mariko Ogawa, Toyohashi (JP); Zenbei Meiwa, Wakayama (JP); Haruyuki Sato, Wakayama (JP)

(73) Assignees: Kao Corporation, Tokyo (JP); Nippon Paper Industries Co., Ltd., Tokyo (JP)

( * ) Notice: Subject to any disclaimer, the term of this patent is extended or adjusted under 35 U.S.C. 154(b) by 144 days.

(21) Appl. No.: 12/680,031

(22) PCT Filed: Oct. 14, 2008

(86) PCT No.: PCT/JP2008/068923

§ 371 (c)(1),
(2), (4) Date: Apr. 30, 2010

(87) PCT Pub. No.: WO2009/048178

PCT Pub. Date: Apr. 16, 2009

(65) Prior Publication Data

US 2010/0206503 A1 Aug. 19, 2010

(30) Foreign Application Priority Data

Oct. 12, 2007 (JP) ..... 2007-267068
Oct. 12, 2007 (JP) ..... 2007-267071

(51) Int. Cl.
*D21F 11/00* (2006.01)

(52) U.S. Cl. ..... 162/158

(58) Field of Classification Search ..... 162/158, 162/206, 205, 135, 181.8
See application file for complete search history.

(56) References Cited

U.S. PATENT DOCUMENTS 4,624,744 A * 11/1986 Vreeland ..... 162/206
2005/0016701 A1 1/2005 Nisogi et al.

FOREIGN PATENT DOCUMENTS

| | | | |
|---|---|---|---|
| CN | 1608160 | A | 4/2005 |
| JP | 63-500188 | A | 1/1988 |
| JP | 3-279496 | A | 12/1991 |
| JP | 4-209894 | A | 7/1992 |
| JP | 6-146197 | A | 5/1994 |
| JP | 2002-293011 | A | 10/2002 |
| JP | 2003-268695 | A | 9/2003 |
| JP | 2004-293003 | A | 10/2004 |
| JP | 2005-248351 | A | 9/2005 |
| JP | 2006-152509 | A | 6/2006 |
| JP | 2006-188783 | A | 7/2006 |
| JP | 2007-107171 | A | 4/2007 |
| JP | 2007-211373 | A | 8/2007 |
| JP | 2007-231444 | A | 9/2007 |
| WO | WO 87/02722 | A1 | 5/1987 |

OTHER PUBLICATIONS

International Search Report mailed Nov. 18, 2008 for International Application No. PCT/JP2008/068923.
Machine translation for JP2002-293011-A.
Machine translation for JP-2003-268695-A.
Machine translation for JP-2004-293003-A.
Machine translation for JP-2005-248351-A.
Machine translation for JP-2006-152509-A.
Machine translation for JP-2006-188783-A.
Machine translation for JP-2007-211373-A.
Machine translation for JP-2007-231444-A.
Notification of the First Office Action issued in corresponding Chinese Application No. 200880110818.1 on Sep. 15, 2011 (with English translation).

* cited by examiner

*Primary Examiner* — Mark Halpern
(74) *Attorney, Agent, or Firm* — Birch, Stewart, Kolasch & Birch, LLP

(57) ABSTRACT

The present invention provides a method for producing a coated paper, including steps of coating a base paper coated with an aqueous solution of a water-soluble polymer with a coating liquid containing at least a pigment and an adhesive to produce a coated paper, and calendering the coated paper having a moisture content of not more than 5.5% by weight. The present invention also provides a method for producing a coated paper, including steps of coating a base paper having a moisture content of not more than 4% by weight with a coating liquid containing at least a pigment and an adhesive to produce a coated paper, and calendering the coated paper having a moisture content of not more than 5.5% by weight.

4 Claims, 2 Drawing Sheets

METHOD FOR PRODUCING COATED PAPER

This application is a 371 of PCT/JP2008/068923 filed on Oct. 14, 2008.

FIELD OF THE INVENTION

The present invention relates to a coated paper and a method for producing the same.

BACKGROUND OF THE INVENTION

In recent printed matters, photographs, illustrations, and colors have been used in rapidly increasing amounts. There has been thus an increasing demand for coated papers year after year, which have a smooth coated layer as an ink-receiving layer on the surface thereof compared with uncoated printing papers. There has been also an increasing demand for papers having lighter weight while keeping traditional paper thickness and printing quality to follow a recent trend of reducing costs. For printing quality of a coated paper, smoothness of a coated layer thereof is important, and the coated paper is generally subjected to a treatment of surface-smoothing with a super calender, a soft nip calender, or the like. However, since the treatment increases smoothness of the surface by pressing the paper, the treatment simultaneously increases a density of the paper and reduces a thickness of the paper. If keeping the thickness, the coated paper will have an increased weight.

In response to these demands, a thick coated paper with a low density having high glossiness and smoothness has been developed. For example, disclosed methods include a method of coating a paper having 0.30 to 1.00 g/cm$^3$ density with an organic polymer gel to form a dried film layer of the gel and coating the paper with a hydrophilic coating material (JP-A2007-107171), a method of subjecting a coated layer containing a copolymer latex having a specific glass transition temperature, an average particle diameter of 100 to 200 nm, and 30% by weight or more of styrene content to a flattening treatment with a heat calender under the condition of 3 to 8% by weight of moisture content of a coated paper on which the coated layer is formed (JP-A2006-188783), and a method of producing a coated paper having a coated layer of 1.5 to 10 g/m$^2$ per side, including a smoothing treatment of a base paper having a water content of 2 to 8% by weight with a calendering apparatus composed of specific rolls before a coating apparatus (JP-A6-146197).

SUMMARY OF THE INVENTION

Invention I is a method for producing a coated paper, including steps of:

coating a base paper with a coating liquid containing at least a pigment and an adhesive to produce a coated paper; and calendering the coated paper, wherein the base paper is coated with an aqueous solution of a water-soluble polymer, and the step of calendering is a step of calendering the coated paper having a moisture content (water content) of not more than 5.5% by weight.

Invention II is a method for producing a coated paper, including steps of:

coating a base paper with a coating liquid containing at least a pigment and an adhesive to produce a coated paper; and calendering the coated paper, wherein the step of coating is a step of coating the base paper having a moisture content of not more than 4% by weight with the coating liquid, and the step of calendering is a step of calendering the coated paper having a moisture content of not more than 5.5% by weight.

The present invention also provides a coated paper having a density of not more than 1.2 g/cm$^3$, prepared by any one of the above methods.

DETAILED DESCRIPTION OF THE INVENTION

JP-A2007-107171 requires a paper containing a polyvalent metal ion and a specific treatment with a water-soluble polymer solution. JP-A2006-188783 is limited to a specific coating liquid. JP-A6-146197 requires a step of smoothing with specific rolls before coating.

The present invention relates to providing a method of producing a coated paper that achieves a desired glossiness while preventing increase of density in calendering (hereinafter, also referred to as having good calendering resistance). The present invention also provides a coated paper satisfying both glossiness and low density.

According to the present invention, a coated paper satisfying both glossiness and low density and a method for producing the same can be provided.

Invention I and Invention II will be described in detail below.

A coated paper is, for example, produced by forming a paper layer on a metal mesh from a diluted liquid of raw pulp, and pressing, drying, sizing, drying, coating, drying and calendering the paper layer, and if needed, conditioning a moisture content of the paper layer. In such steps, the present invention is characterized by the base paper used in the step of coating and the step of calendering. In the present invention, a paper before the step of coating is referred to as a base paper, a paper after the step of coating is referred to as a coated paper.

[The Step of Coating in Invention I]

The step of coating according to the present invention is a step of coating a base paper with a coating liquid to produce a coated paper. The coating with the coating liquid may be performed either on one side or both sides of the base paper.

In the present invention, from the viewpoint of glossiness, the base paper used in the step of coating is coated with an aqueous solution of a water-soluble polymer on the surface thereof. The aqueous solution of the water-soluble polymer can be considered as an external agent for papermaking. In this context, it is distinguished from a fiber-binding inhibitor, below described. The base paper may be coated with the aqueous solution of the water-soluble polymer on one side or both sides. It is assumed that use of the base paper coated with the aqueous solution of the water-soluble polymer on the surface thereof suppresses penetration of a pigment into the base paper in coating the coating liquid to thereby increase a thickness of a coated layer, the surface of the thicker layer is more flattened by calendering, resulting in a coated paper having increased glossiness. Examples of the water-soluble polymer include: cellulose compounds such as sodium carboxymethylcellulose, methyl cellulose, ethyl cellulose, and hydroxyalkyl cellulose; starches such as raw starch, oxidized starch, carboxymethyl starch, dialdehyde starch, phosphate-modified starch, and hydroxyalkyl-modified starch; sugars such as sucrose and lactose; other natural polymers such as glue, gelatin, casein, and agar; polyvinyl alcohols such as polyvinyl alcohol and modified polyvinyl alcohols; (meth) acrylate polymers such as alkali salts of poly(meth)acrylic acids, alkali salts of (meth)acrylic acid/(meth)acrylate copolymers, and alkali salts of acrylic acid/maleic acid copolymers; other synthetic polymers such as polyacrylamide polymers, modified polyacrylamides, styrene/maleic acid polymers, water-soluble polyesters, polyethylene oxides, and polyvinylpyrrolidones; and vinyl copolymers produced by copolymerizing monomers containing at least monomer selected from cationic group-containing vinyl monomers, such as a (meth)acrylic acid ester or (meth)acrylamide having a dialkylamino group, styrene having a dialkylamino group, vinylpyridine or an N-vinyl heterocyclic compound, a neutralized acid monomer or a quaternary ammonium salt having an amino group, and a diallyl-type quaternary ammonium salt and hydrophilic nonionic group-containing vinyl monomers such as N-alkyl(meth)acrylamides and N,N-dialkyl(1 to 3 carbon atoms)-substituted (meth)acrylamides. These vinyl monomers may be used alone or in combination. For the vinyl copolymer, preferred are cationic-group containing vinyl copolymers produced by copolymerizing monomers containing a cationic-group containing vinyl monomer and a hydrophilic nonionic-group containing vinyl monomer, and more preferred are cationic-group containing vinyl copolymers produced by copolymerizing monomers containing a cationic-group containing vinyl monomer and a hydrophilic nonionic-group containing vinyl monomer as main components. The vinyl copolymers may be vinyl copolymers produced by copolymerizing monomers as above and a cross-linking vinyl monomer having at least two vinyl groups as a constituting unit in a molecule. For the cationic-group containing copolymer, the total amount of the hydrophilic nonionic-group containing vinyl monomers and the cationic-group containing vinyl monomers in the constituting monomer units is preferably 80 to 100% by mol, and more preferably 90 to 99.9% by mol. Among these water-soluble polymers, preferred are one or more compounds selected from starches, cellulose compounds, polyvinyl alcohols, and cationic-group containing vinyl copolymers produced by copolymerizing monomers containing a cationic-group containing vinyl monomer and a hydrophilic nonionic-group containing vinyl monomer as main components. A concentration of the water-soluble polymer in the aqueous solution is preferably 0.1 to 15% by weight, and more preferably 0.5 to 5% by weight. From the viewpoint of weight reduction of a coated paper, the aqueous solution of the water-soluble polymer preferably differs from the coating liquid.

From the viewpoint of ease of application, a viscosity (25° C.) of the aqueous solution of the water-soluble polymer is preferably 1 to 5000 mPa·s, and more preferably 1 to 3000 mPa·s.

The aqueous solution of the water-soluble polymer can be applied with a common coating apparatus for papermaking without specific limitation. Examples of the coating apparatus include a 2-roll size press coater, a film-transferring type roll coater such as a gate roll coater, blade metered size press coater, rod metered size press coater, and a Sym-Sizer, a curtain coater, a dye coater, a gravure coater, a kiss coater, a rod (bar) coater, a roll coater, and a spray.

An application amount of the aqueous solution of the water-soluble polymer is not specifically limited, but from the viewpoint of reduction of weight, preferably 0.01 to 15 g/m$^2$, more preferably 0.1 to 10 g/m$^2$, even more preferably 0.1 to 5.0 g/m$^2$, and even more preferably 0.1 to 1.0 g/m$^2$ per side based on solid content.

[The Step of Coating in Invention II]

The step of coating according to the present invention is a step of coating a base paper having a moisture content of 4% by weight or less with a coating liquid to produce a coated paper. Coating with the coating liquid may be performed on one side or both sides of the base paper. When coating with the coating liquid is performed twice or more, such as coating on both sides of the base paper, a moisture content of the base paper is 4% by weight or less in at least one time of coating. It is preferably 4% by weight or less in all times of coating, more preferably 3% by weight or less, and even more preferably 2% by weight or less.

The present invention can produce the coated paper having an increased glossiness. This is assumed to be because use of a base paper having a moisture content adjusted to low level in the step of coating causes rapid penetration of water in a coating liquid into the base paper in coating and rapidly increases solid contents on the surface of the base paper. As a result, a coating pigment accumulates on the surface of the base paper without penetrating into the base paper, a thickness of a coated layer on the surface of the base paper is kept, the surface of the coated layer is more flattened by calendering, and the coated paper after the step of calendering has an increased glossiness.

Examples of a method for adjusting a moisture content of the base paper include adjustment of conditions in a step of drying before the step of coating. A method of drying in the step of drying is not specifically limited. Examples of the method include steam drying, drying with a gas heater, drying with an electrical heater, and drying with an infrared heater. It is also possible to adjust a moisture content of a base paper by increasing a moisture content from a dried state, for example, by drying to 0% by weight moisture content and then increasing to a desired moisture content.

A moisture content of the base paper can be measured with a BM meter (Basis weight/Moisture meter) or by drying the base paper absolutely and measuring a loss in weight.

In Invention II, from the viewpoint of increased glossiness of a coated paper, the base paper used in the step of coating is preferably coated with an aqueous solution of a water-soluble polymer on the surface thereof. The water-soluble polymer is preferably as described above.

[The Step of Coating in Invention I and Invention II]

For the base paper coated with the aqueous solution of the water-soluble polymer of Invention I or the base paper having a moisture content of 4% by weight or less of Invention II, a usual base paper for coated paper can be used. For papermaking to produce a base paper, usual paper machines such as a Fourdrinier, a cylinder, a short net, a twin-wire, and a tilted wire paper machines can be used. From the viewpoint of smaller difference between the surface and the back surface of a paper, a twin-wire paper machine is particularly preferred.

For a pulp used in the base paper, any pulp derived from vegetable fibers such as wood and plant fibers can be used, including bleached chemical pulps such as NBKP and LBKP, mechanical pulps such as TMP, CTMP, GP, and RGP and bleached products thereof, high-yield pulps such as SCP and CGP and bleached products thereof, and recycled pulps such as waste pulp and de-inked waste pulp (DIP) and bleached product thereof (BDIP). From the viewpoint of glossiness of a coated paper, a pulp to be used preferably contains a chemical pulp in an amount of 50% by weight or more.

In papermaking, additives generally used may be added according to need, including a sizing agent, a filler, a yield improver, an improver for water leak properties, and a paper strength improver. Examples of the sizing agent include alkyl ketene dimer, alkenyl succinic anhydride, and a neutral rosin sizing agents. Examples of the filler include calcium carbonate.

From the viewpoint of low density, the base paper is more preferably produced by papermaking with a pulp slurry containing a fiber-binding inhibitor.

Addition of the fiber-binding inhibitor enables to provide a coated paper having a supple feel to the touch with preventing increase in density of the coated paper. This is assumed to be because the coated paper subjected to the step of calendering has pulp distances tending to increase since the paper contains the fiber-binding inhibitor and is controlled to have a low moisture content before the step of calendering to allow hydrogen bonding sites of pulp fibers in the paper to directly form a hydrogen bond with each other without water, thereby hardening the whole pulp fibers. The coated paper containing fully hardened pulp fibers is hard to be crushed under a pressure by calendering to prevent increase in density, while a coated layer on the surface is flattened by calendering. It is also assumed that the fiber-binding inhibitor on the surface of the pulp decreases friction among pulps, and thus preserved pulp fibers impart a supple feel. These possible mechanisms will achieve both low density and a supple feel.

The fiber-binding inhibitor is a compound functioning to prevent pulp fibers from bonding with each other. Used for the fiber-binding inhibitor is a compound used as a surfactant having hydrophobic and hydrophilic groups, including a bulk filler for paper, for example. A hydrophilic group in the bulk filler for paper adsorbs on the surface of a pulp and a hydrophobic group prevents pulp fibers from bonding with each other. Voids in the base paper are thus larger than those in cases without a bulk filler for paper and the base paper has lower density. The fiber-binding inhibitor can be considered as an internal additive for papermaking and added to a pulp slurry as an emulsion or dispersion thereof in water. Examples of the compound include ester compounds and derivatives thereof such as fatty acid polyhydric alcohol esters, fatty acid polyhydric alcohol ester-polyoxyalkylene adducts, higher fatty acid ester-polyoxyalkylene adducts, polyhydric fatty acid alcohol esters, polyhydric fatty acid alcohol esters-polyoxyalkylene adducts, ester compounds produced from polyamine-polyoxyalkylene adducts and fatty acids, compounds produced by introducing an anion group to a hydroxy group of an ester compound of a polyhydric alcohol with a fatty acid or hydroxycarboxylic acid, ester compounds of linear fatty acid amine-polyoxyalkylene adducts with fatty acids, and ester compounds of higher alcohol-polyoxyalkylene adducts with fatty acids; amide compounds and derivatives thereof such as fatty acid monoamides, fatty acid amide amine-polyoxyalkylene adducts, fatty acid poly(amideamine)s, fatty acid di(amideamine)s, polyalkylenepolyamine-fatty acid-epichlorohydrin condensates, polyalkylenepolyamine-fatty acid-urea condensates, amide compounds produced from polyhydric fatty acids and polyamines, and amide compounds produced from polyhydric fatty acids and linear amines; compounds having an amide bond and an ester bond in a molecule such as ester compounds produced from fatty acid amide amine-polyoxyalkylene adducts with fatty acids; other polyoxyalkylene adducts and derivatives thereof such as higher alcohol-polyoxyalkylene adducts, higher fatty acid-polyoxyalkylene adducts, polyhydric alcohol nonionic surfactants, sugar alcohol-based nonionic surfactants, sugar-based nonionic surfactants, and oil-and-fat-based nonionic surfactants; and other compounds such as higher alcohols, sulfosuccinic acid derivatives, polymers containing a constitution unit having a part having surface activity and at least one constitution unit derived from anionic monomers and cationic monomers. From the viewpoint of decreased density of coated paper, among these compounds, preferably used are ester compounds and derivatives thereof, amide compounds and derivatives thereof, and the other polyoxyalkylene adducts and derivatives thereof, and more preferably used are fatty acid polyhydric alcohol esters, fatty acid monoamides, fatty acid di(amideamine)s, fatty acid poly(amideamine)s, polyalkylenepolyamine-fatty acid-epichlorohydrin condensates, polyalkylenepolyamine-fatty acid-urea condensates, and higher alcohol-polyoxyalkylene adducts.

The fiber-binding inhibitor is preferably used in an amount of 0.01 to 10 parts by weight, more preferably 0.1 to 5 parts by weight, and even more preferably 0.1 to 1.5 parts by weight with respect to 100 parts by weight of pulp. When the fiber-binding inhibitor is used, a fixing promoter for promoting fixing of the fiber-binding inhibitor on pulps such as polyacrylamide polymers, cationized starches, and sulfuric acid bands is preferably used.

In the present invention, from the viewpoint of increase of glossiness of a coated paper, the base paper can be calendered. For calendering, a calendering apparatus such as a machine calender, a super calender, a soft calender, and a gloss calender can be used. These may be used together.

The coating liquid contains at least a pigment and an adhesive. Examples of the pigment that can be used include inorganic pigments such as kaolin, precipitated calcium carbonate, fine-grained heavy calcium carbonate, pyrophyllite clay, titanium dioxide, satin white, barium sulfate, and aluminium hydroxide and organic pigments such as plastic pigments. Among them, from the viewpoint of economic efficiency, inorganic pigments are preferred.

Examples of the adhesive (binder) in the coating liquid include aqueous solutions of polymers such as casein, starch derivatives, and cellulose derivatives and emulsions of synthetic latexes such as SBR (styrene-butadiene rubber) and MBR (methyl methacrylate-butadiene rubber). A ratio of the pigment to the adhesive, which may be varied according to a kind of the pigment and an intended use, is preferably 10 to 50 parts by weight of the adhesive with respect to 100 parts by weight of the pigment. The coating liquid may further contain a paint additive such as a dye, a defoaming agent, a lubricant, a dispersant, a viscosity controlling agent, and a pH controlling agent in addition to the pigment and the adhesive. A solid content of the coating liquid is preferably not less than 30% by weight, around 40% by weight when coated with an air knife coater, or 50 to 70% by weight when coated with a blade coater. A thickness of a coated layer is arbitrarily determined according to an intended use, quality, and the like of the coated paper without specific limitation. From the viewpoint of producing a glossy paper, a coated amount of the coating liquid per side is preferably not less than 11 $g/m^2$, more preferably 11 to 25 $g/m^2$, and even more preferably 12 to 20 $g/m^2$, based on solid content. In general, a paper coated with the more amount of a coating liquid is the heavier and is more difficult to reduce a weight thereof. However, in the present invention, the coated paper has a density prevented from increasing after calendered. The present invention thus can produce a coated paper of lightweight even when a large amount of a coating liquid has been coated.

The coating liquid can be applied to the base paper with a common coating apparatus for paper without specific limitation. Examples of the coating apparatus include a 2-roll size press coater, a film-transferring type roll coater such as a gate roll coater, blade metered size press coater, rod metered size press coater, and a Sym-Sizer, a curtain coater, a dye coater, a gravure coater, a kiss coater, a rod (bar) coater, an air-knife coater, a blade coater, a roll coater, and a spray.

[Step of Calendering]

The step of calendering according to the present invention processes the coated paper prepared by the step of coating and conditioned to have a moisture content of not more than 5.5% by weight by calendering. When the coated paper is calendered several times, a moisture content thereof before each calendering is not more than 5.5% by weight at least one time of calendering operations, and preferably all times of the calendering operations.

From the viewpoint of producing a glossier coated paper, a moisture content of the coated paper before calendering (before each calendering operation) is preferably 1 to 5.5% by weight, more preferably 2 to 5% by weight, and even more preferably 3 to 4% by weight. From the viewpoint of producing a coated paper having lower density, the moisture content of the coated paper before calendering is preferably 0 to 4% by weight, more preferably 0 to 3% by weight, and even more preferably 0 to 2% by weight. For achieving both of high glossiness and low density, the moisture content of the coated paper before calendering is preferably 1 to 4% by weight, and more preferably 2 to 3% by weight.

The present invention can produce a coated paper having increased glossiness while preventing a density from increasing. This is assumed to be because, since a moisture content of the coated paper used in the step of calendering is decreased to a level lower than usual, hydrogen bonding sites of pulp fibers in the coated paper directly form a hydrogen bond with each other without water, thereby hardening the whole pulp fibers. The coated paper containing fully hardened pulp fibers is hard to be crushed under a pressure by calendering to prevent increase in density of a pulp layer. It is expected that the coated paper after the step of calendering has an increased glossiness because the surface of a coated layer is more flattened by calendering. It is expected that the present invention has both low density and glossiness because of preventing the pigment from penetration into the base paper in applying the coating liquid onto the base paper, as described above, previously coated with the aqueous solution of the water-soluble polymer, and then preventing the density of the pulp layer from increasing and smoothing the coated layer in the step of calendering.

For adjusting a moisture content of the coated paper before calendering, conditions (e.g., temperature, humidity, blowing rate, and time) of the step of drying before the step of calendering are adjusted, for example. Examples of a method for drying include steam drying, drying with a gas heater, drying with an electrical heater, and drying with an infrared heater. In a general method of papermaking, a moisture content of a coated paper before calendering is about 6 to 7% by weight.

A moisture content of the coated paper can be measured with a BM meter (Basis weight/Moisture meter) or by drying an uncoated paper absolutely and measuring a loss in weight.

In calendering, a calendering apparatus such as a super calender, a soft calender, a machine calender, and a gloss calender can be used. These may be used together. A surface temperature of a calender is not specifically limited, but preferably not lower than 50° C. From the viewpoint of producing a glossy coated paper, a super calender apparatus and a soft calender apparatus are preferably used.

Since the coated paper before calendering according to the present invention is hard to be crushed under pressure of calendering, a calendering pressure (a pressure applied on the paper measured according to the method described in Examples) can be set to 9 to 80 MPa, more preferably 9 to 50 MPa. From the viewpoint of glossiness and low density of the coated paper, the calendering pressure is preferably 25 to 80 MPa, and more preferably 25 to 50 MPa. From the viewpoint of increasing glossiness, the number of calendering operation is preferably two times or more.

[Step of Conditioning Humidity]

The method of the present invention preferably further includes a step of conditioning humidity to increase a moisture content of the coated paper after the step of calendering. The step of conditioning humidity decreases a density of the coated paper that has increased by the step of calendering to produce a coated paper having lower density. This is assumed to be because the coated paper pressed through the step of calendering swells by hydrogen bonding among pulps via water. The step preferably increases a moisture content of the coated paper by 0.1 to 9 points from that before calendering, more preferably 1 to 7 points, and even more preferably 2.5 to 6 points, based on % by weight. In other words, a moisture content of the coated paper after conditioned is preferably (the moisture content of the coated paper before calendering+0.1) to (the moisture content of the coated paper before calendering+9) (% by weight), more preferably (the moisture content of the coated paper before calendering+1) to (the moisture content of the coated paper before calendering+7) (% by weight), and even more preferably (the moisture content of the coated paper before calendering+2.5) to (the moisture content of the coated paper before calendering+6) (% by weight).

For an apparatus for conditioning humidity, a water applying apparatus, an electrostatic humidifier, an evaporative humidifier, and the like can be used with the calender. These may be optionally used together.

[Coated Paper]

The coated papers are produced by Invention I and Invention II as described above, and preferably have a density of not more than 1.2 g/cm$^3$, more preferably not more than 1.18 g/cm$^3$, even more preferably not more than 1.15 g/cm$^3$, even more preferably 1.1 to 0.5 g/cm$^3$, and even more preferably 1.0 to 0.6 g/cm$^3$.

The coated paper of the present invention is applicable to various papers. Examples of the paper include a coated paper for books and magazines, a coated paper for printing such as for catalogs and posters, an electrophotographic transfer paper, an inkjet printing paper, an information paper used in a heat sensitive paper, and a wrapping paper.

Specific examples of the paper preferably include a cast coated paper, an A0 art paper, an A1 art paper, an A2 coated paper, an A3 coated paper, a lightweight coated paper, and a medium quality coated paper.

EXAMPLES

Figure 1:
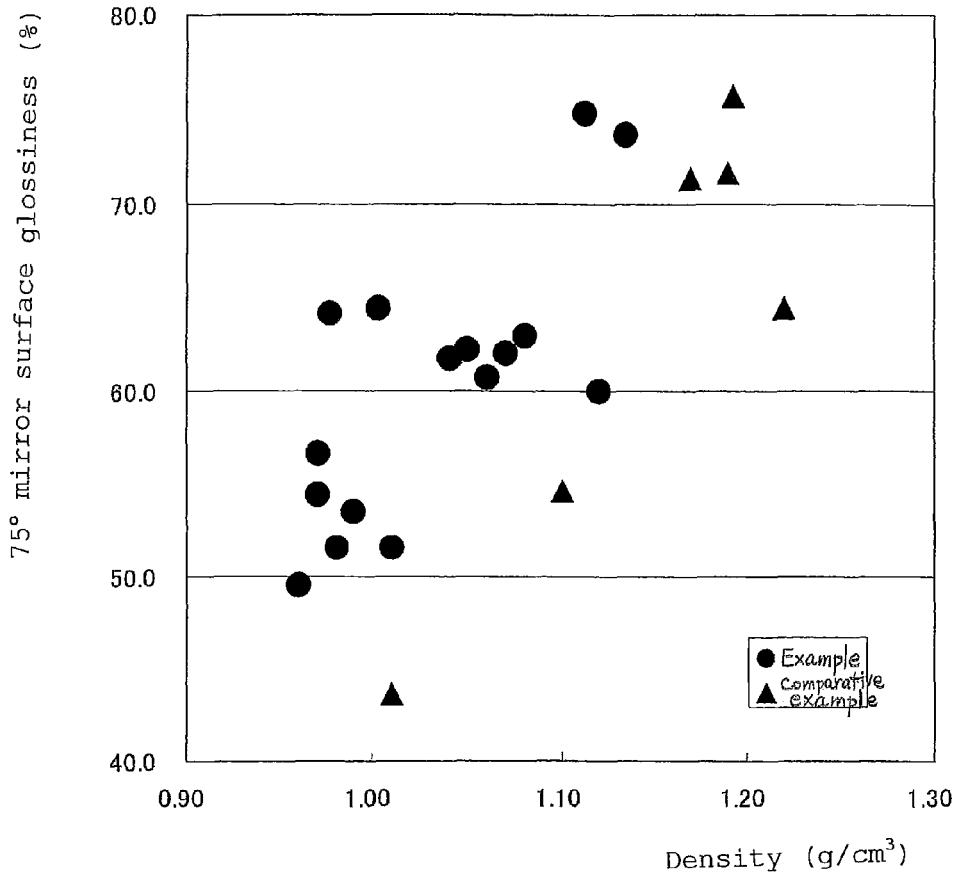
FIG. 1 is a graph showing a relationship between density and 75° mirror surface glossiness of each coated paper obtained in Examples and Comparative Examples of Invention I.

The following Examples demonstrate the present invention. Examples are intended to illustrate the present invention and not to limit the present invention.

Examples 1 to 16 are for Invention I, and Examples 21 to 38 for Invention II.

Examples 1

(1) Preparation of a Base Paper

A chemical pulp, LBKP (leaf bleached kraft pulp), was used as a raw material. It was disintegrated and beaten with a beater at 25° C. to produce an LBKP slurry of a pulp concentration of 2.2% by weight. The slurry had a Canadian standard freeness (JIS P 8121) of 450 ml. The LBKP slurry in such amount as that a sheet made therefrom had a basis weight of about 80 g/m$^2$ was diluted with water so that a pulp concentration was 0.5% by weight, stirred, and subjected to papermaking on a 80-mesh wire with a square Tappi paper machine to produce a wet sheet. The wet sheet was pressed for five minutes under the pressure of 3.5 kg/cm$^2$ with a press machine and dried for two minutes at 105° C. in a drum drier to produce a pulp sheet. The obtained pulp sheet was conditioned for its humidity for 12 hours under the conditions of 23° C. and a relative humidity of 50%, and subjected to calendering under the conditions below in order to prepare a base paper having a uniform roughness over the surface. The base paper thus prepared was conditioned for its humidity to have a moisture content of 5% by weight.

<Conditions for Calendering a Pulp Sheet>

Using a labo calendering apparatus (Kumagai Riki Kogyo Co., Ltd., super calender model 30FC-200E), a pulp sheet was subjected to calendering (linear pressure: 10 kg/cm, treating rate: 10 m/min, roll temperature: 80° C., times of calendering: twice) under the conditions of 23° C. and a relative humidity of 50%.

(2) A Method of Water-Soluble Polymer Treatment (2-1) Examples 1, 2, 7, 8, 11, and 12, and Comparative Example 4

An aqueous solution of 1.0% by weight of carboxymethylcellulose sodium salt (Nippon Paper Chemicals Co., Ltd, F10LC, referred to as CMC in Table 1) was spread over a glass plate with a bar coater (No. 14) to form a cast film on the glass plate. A base paper (width: 12 cm, length: 12 cm) prepared above was placed on the cast film, and covered with a filter paper of 100 g/m$^2$. A roll (diameter: 200 mm, width: 200 mm, linear pressure: 230 g/cm) was rolled over the paper to transfer the liquid film of the aqueous CMC solution from the glass plate to the surface of the base paper. The paper was then dried for two minutes at 105° C. with a mirror-finished dryer. These operations were quickly performed in no time between operations. The dried pulp sheet was conditioned for its humidity for one day under the conditions of 23° C. and 50% humidity. These operations were performed for both sides of the base paper.

(2-2) Examples 3, 4, 9, 10, 13, and 14, and Comparative Example 5

Base papers were treated on both sides in the same way as in the method in (2-1), except that a CMC concentration of an aqueous CMC solution was 2.0% by weight.

(2-3) Examples 5, 6, 15, and 16 and Comparative Example 6

Base papers were treated on both sides in the same way as in (2-1), except that an aqueous solution of 1.0% by weight of water-soluble polymer C prepared by the method described below was used instead of the aqueous CMC solution.

*Preparation Example of Water-Soluble Polymer C

In a 1 L beaker, 267.4 g of ion-exchanged water, 185.63 g of MOEDES (equimolar adduct of dimethylaminoethyl methacrylate and dimethylsulfuric acid, both were reagents, Wako Pure Chemical Industries, Ltd.), 110.46 g of DMAAm (N,N-dimethylacrylamide, reagent, Wako Pure Chemical Industries, Ltd.), 0.415 g of NK-14G (cross-linking agent, polyethylene glycol dimethacrylate, Shin Nakamura Chemical Co., Ltd.), and 0.952 g of V-50 (polymerization initiator, 2,2'-azobis(2-amidinopropane)dihydrochloride, Wako Pure Chemical Industries, Ltd.) were mixed to produce an aqueous monomer solution a.

In a 5 L glass container, 1648 g of cyclohexane and 1.94 g of sugar ester S-770 (Mitsubishi Chemical Corporation) as a dispersant were treated for one hour at 60° C. to dissolve uniformly, and cooled to 30° C. to produce a dispersant solution b.

The aqueous monomer solution a was added to the dispersant solution b. A mixture was stirred for four minutes at a rotation number of 9000 with a homomixer (ROBOMICS, Primix Corporation) to produce a monomer dispersant having an average particle diameter of 5 μm. The whole dispersant was placed in a 5 L SUS tank equipped with a stirrer, a thermometer, and a condenser. The inside of the reaction system was replaced with nitrogen. The dispersant was heated to 55° C. and polymerized for one hour at the temperature. The dispersant was aged for one hour at 70° C. Then, a dehydrator having a condenser was installed to the reaction system to remove 269 g of water. With progress of dehydration, an inside temperature of the tank rose from 70° C. to 90° C.

The reaction system was cooled to 40° C. or lower, and the reaction mixture was transferred onto a stainless tray. The mixture was dried at 80° C. by hot-air blowing, shortly milled for about one second with a household coffee mill to produce a water-soluble polymer C having an average particle diameter of 4.0 μm.

(3) Preparation of a Coated Paper

Steps of Coating, Calendering, and Humidity-Conditioning

A first side of a base paper (pulp sheet) thus coated with the aqueous solution of water-soluble polymer was coated with a coating liquid, which was prepared by mixing 50 parts of heavy calcium carbonate, 50 parts of fine kaolin particle, 0.075 parts of dispersant (Poiz 535M: Kao Corporation), 0.02 parts of sodium hydroxide, 11 parts of latex, 3 parts of starch and water in such amount as that a solid content was 65% by weight, in an amount of 15 g/m$^2$ (based on solid content) per side using a labo blade coater (Kumagai Riki Kogyo Co., Ltd., rate: 25 m/min). The coated base paper was dried for 2 minutes at 105° C. in a drum drier. A second side of the coated base paper (uncoated side opposite to the first side) was coated with the coating liquid in an amount of 15 g/m$^2$ (based on solid content) per side using the labo blade coater. The coated base paper was dried for 2 minutes at 105° C. in a drum drier to produce a coated paper.

The resultant coated paper was dried to a moisture content of 2% by weight, and subjected to calendering under the conditions below such that the first side contacted with a metal roll. The treated coated paper was dried to a moisture content of 2% by weight, and subjected to calendering under the conditions below such that the second side contacted with a metal roll. The treated coated paper was conditioned for its humidity for 12 hours under the conditions of 23° C. and a relative humidity of 50% to produce a coated paper having a moisture content of 5% by weight in the paper.

<Conditions for Calendering a Coated Paper>

Using a labo calendering apparatus (Kumagai Riki Kogyo Co., Ltd., super calender model 30FC-200E), the coated paper was calendered (linear pressure: 200 kg/cm, treating rate: 10 m/min, roll temperature: 80° C., times of calendering: once) under the conditions of 23° C. and a relative humidity of 50%. A surface temperature of a metal roll of the calendering apparatus was set using a temperature setting means of the apparatus. For confirmation, the surface temperature was measured with a thermometer (Digital Thermometer Model 2455 (available from Iuchi)) to be correct.

Examples 2 to 16 and Comparative Examples 1 to 6

Coated papers were prepared in the same way as in Example 1, except that applied amounts of water-soluble polymers and a moisture content of a coated paper before calendering were changed to values shown in Table 1.

In the present invention, a moisture content of a coated paper before calendering was measured as follows. A coated paper before calendering is cut into a piece of 12 cm by 12 cm. The piece is placed in a 200 ml media vial, dried for 30 minutes at 105° C., sealed with a cap, and cooled to a room temperature. A moisture content of the coated paper in this state is considered as 0% by weight. The piece of the coated paper having a moisture content of 0% by weight is conditioned for its humidity under the conditions of 23° C. and a relative humidity of 65% while monitoring an increase of weight. When a moisture content reaches a desired value, the piece is subjected to calendering as described in (3). A moisture content of the piece in this state is considered as that of the coated paper before calendering. A moisture content refers to a percentage by weight of water with respect to a weight of a coated paper.

A relationship between a linear pressure of the labo calendering apparatus and a pressure applied on a coated paper was determined by the following method. Under the conditions described above, a pressure-sensitive paper "Prescale" (Fujifilm Corporation) was passed through the Labo calendering apparatus with various linear pressures. Coloring of the paper by a linear pressure was used to determine a pressure applied on the paper at the linear pressure. For measuring at a linear pressure less than 100 kg/cm, a pressure-sensitive paper for middle pressure was used, and for measuring 100 kg/cm or higher, a pressure-sensitive paper for high pressure was used. The results were as follows: a pressure of 9 MPa for a linear pressure of 21 kg/cm, 25 MPa for 42 kg/cm, 49 MPa for 200 kg/cm, 56 MPa for 250 kg/cm, and 80 MPa for 500 kg/cm.

In Examples 7 to 10, for producing a base paper, to an LBKP slurry was added an emulsion of 1% by weight of pentaerythritol monostearate (in Table 1, referred to as ester compound A) in an amount of effective content as shown in Table 1, stirred, and diluted with water such that a pulp concentration was 0.5% by weight. To this was added an aqueous solution of 0.05% by weight of polyacrylamide polymer (Ciba Specialty Chemicals, PERCOL 47) in an amount of 0.03 parts by weight with respect to 100 parts by weight of pulp, stirred, and subjected to papermaking on a 80-mesh wire with a square Tappi paper machine to produce a wet sheet. The ester compound A was used in the state of emulsion, prepared by mixing in water with a cationized starch as an emulsifier, using a homomixer (Primix Corporation, Robomix).

In Examples 11 to 16, an aqueous dispersant of 1% by weight of polyalkylenepolyamine-fatty acid-epichlorohydrin condensate (amide compound derivative B) prepared by the method below was used instead of pentaerythritol monostearate above in an amount of effective content as shown in Table 1. The following operations were performed in the same way as Example 7 to produce a wet sheet.

*Preparation of Amide Compound Derivative B

An inside of a flask containing 1061.1 g of palmitic acid/stearic acid mixture (Kao Lunac S-40, 3.854 mol) and 208.5 g of tetraethylenepentamine (considered as 4.652 mol of amino group from a total amine value of 1251.9 mg KOH/g) was substituted with nitrogen. Amidation was carried out at 200° C. and ambient pressure under nitrogen flow. When an acid value was confirmed to decrease to less than 5, the reaction mixture was cooled to 95° C., added with 19 g of water to carry out hydrolysis to produce polyamideamine (a total amine value: 55 mg KOH/g). To this was added 99.86 g of epichlorohydrin (1.079 mol) dropwise at 90 to 100° C. and aged for additional three hours at 110° C. to produce an amide compound derivative B. The resultant amide compound derivative B was added to a pulp slurry by cooling and solidify it and dispersing it in water with a homomixer (Primix Corporation, Robomix).

<Evaluation>

Coated papers prepared in Examples 1 to 16 and Comparative Examples 1 to 6 were measured for density in accordance with JIS-P8118, and for white paper glossiness in accordance with JIS-P8142. The white paper glossiness was measured at both sides of a paper and used to calculate an average value. Results are shown in Table 1.

TABLE 1

| | | Fiber-binding inhibitor | | Water-soluble polymer | | Moisture content (% by weight) | | |
|---|---|---|---|---|---|---|---|---|
| | | kind | Added amount (part*) | kind | Amount coated per side (g/m$^2$) | Coated paper before calendering | Density (g/cm$^3$) | 75° mirror surface glossiness (%) |
| Example | 1 | — | — | CMC | 0.5 | 2 | 1.01 | 51.6 |
| | 2 | — | — | CMC | 0.4 | 4 | 1.12 | 60.0 |
| | 3 | — | — | CMC | 0.7 | 2 | 0.99 | 53.5 |
| | 4 | — | — | CMC | 0.7 | 4 | 1.08 | 63.0 |
| | 5 | — | — | Water-soluble polymer C | 0.7 | 2 | 1.00 | 64.4 |
| | 6 | — | — | Water-soluble polymer C | 0.7 | 4 | 1.14 | 73.7 |
| | 7 | Ester compound A | 0.5 | CMC | 0.3 | 2 | 0.96 | 49.5 |
| | 8 | Ester compound A | 0.5 | CMC | 0.3 | 4 | 1.07 | 62.0 |
| | 9 | Ester compound A | 0.5 | CMC | 0.6 | 2 | 0.97 | 56.7 |

TABLE 1-continued

| | | Fiber-binding inhibitor | | Water-soluble polymer | | Moisture content (% by weight) | | |
|---|---|---|---|---|---|---|---|---|
| | | kind | Added amount (part*) | kind | Amount coated per side (g/m$^2$) | Coated paper before calendering | Density (g/cm$^3$) | 75° mirror surface glossiness (%) |
| | 10 | Ester compound A | 0.5 | CMC | 0.6 | 4 | 1.04 | 61.8 |
| | 11 | Amido compound derivative B | 0.5 | CMC | 0.4 | 2 | 0.98 | 51.6 |
| | 12 | Amido compound derivative B | 0.5 | CMC | 0.4 | 4 | 1.06 | 60.7 |
| | 13 | Amido compound derivative B | 0.5 | CMC | 0.7 | 2 | 0.97 | 54.4 |
| | 14 | Amido compound derivative B | 0.5 | CMC | 0.6 | 4 | 1.05 | 62.2 |
| | 15 | Amido compound derivative B | 0.5 | Water-soluble polymer C | 0.7 | 2 | 0.98 | 64.1 |
| | 16 | Amido compound derivative B | 0.5 | Water-soluble polymer C | 0.7 | 4 | 1.11 | 74.8 |
| Comparative example | 1 | — | — | — | — | 2 | 1.01 | 43.6 |
| | 2 | — | — | — | — | 4 | 1.10 | 54.6 |
| | 3 | — | — | — | — | 6 | 1.22 | 64.4 |
| | 4 | — | — | CMC | 0.3 | 6 | 1.19 | 71.7 |
| | 5 | — | — | CMC | 0.7 | 6 | 1.17 | 71.7 |
| | 6 | — | — | Water-soluble polymer C | 0.7 | 6 | 1.19 | 75.7 |

*Parts by weight with respect to 100 parts by weight of pulp based on solid content FIG. 1 collectively shows respective relations between density and 75° mirror surface glossiness of Examples and Comparative Examples based on results in Table 1. From Table 1 and FIG. 1, it can be seen that Examples have higher glossiness than that of Comparative Examples having almost the same densities, and lower densities than those of Comparative Examples having almost the same glossinesses, and therefore, the present invention achieves both low density and high glossiness.

Example 21

(1) Preparation of a Base Paper

A chemical pulp, LBKP (leaf bleached kraft pulp), was used as a raw material. It was disintegrated and beaten with a beater at 25° C. to produce a LBKP slurry of a pulp concentration of 2.2% by weight. The slurry had a Canadian standard freeness (JIS P 8121) of 450 ml. The LBKP slurry in such amount as that a sheet made therefrom had a basis weight of about 80 g/m$^2$ was diluted with water so that a pulp concentration was 0.5% by weight, stirred, and subjected to papermaking on a 80-mesh wire with a square Tappi paper machine to produce a wet sheet. The wet sheet was pressed for five minutes under the pressure of 3.5 kg/cm$^2$ with a press machine and dried for two minutes at 105° C. in a drum drier to produce a pulp sheet. The obtained pulp sheet was conditioned for its humidity for 12 hours under the conditions of 23° C. and a relative humidity of 50%, and subjected to calendering under the conditions below in order to prepare a base paper having a uniform roughness over the surface. The base paper thus prepared was conditioned for its humidity for 12 hours under the conditions of 23° C. and a relative humidity of 65% to produce a base paper having a moisture content of 5% by weight.

The conditions for calendering the pulp sheet were the same as those in Example 1.

(2) Preparation of a Coated Paper

Steps of Coating, Calendering, and Humidity-Conditioning

The base paper thus prepared was dried to a moisture content of 0% by weight. A first side of the base paper (pulp sheet) was coated with a coating liquid, which was prepared by mixing 50 parts of heavy calcium carbonate, 50 parts of fine kaolin, 0.075 parts of dispersant (Poiz 535M: Kao Corporation), 0.02 parts of sodium hydroxide, 11 parts of latex, 3 parts of starch and water in such amount as that a solid content was 65% by weight, in an amount of 15 g/m$^2$ (based on solid content) per side using a labo blade coater (Kumagai Riki Kogyo Co., Ltd., rate: 25 m/min). The coated base paper was dried for two minutes at 105° C. in a drum drier. The one-side coated paper was dried to a moisture content of 0% by weight. A second side of the one-side coated paper (uncoated side opposite to the first side) was coated with the coating liquid in an amount of 15 g/m$^2$ (based on solid content) per side using the labo blade coater. The coated base paper was dried for 2 minutes at 105° C. in a drum drier to produce a coated paper.

The resultant coated paper was dried to a moisture content of 0% by weight, and subjected to calendering under the conditions below such that the first side contacted with a metal roll. The treated coated paper was dried to a moisture content of 0% by weight, and subjected to calendering under the conditions below such that the second side contacted with a metal roll. The treated coated paper was conditioned for humidity for 12 hours under the conditions of 23° C. and a relative humidity of 50% to produce a coated paper having a moisture content of 5% by weight in the paper.

The conditions for calendering the coated paper were the same as those in Example 1.

Using a labo calendering apparatus (Kumagai Riki Kogyo Co., Ltd., super calender model 30FC-200E), the coated paper was calendered (linear pressure: 200 kg/cm, treating rate: 10 m/min, roll temperature: 80° C., times of calendering: once) under the conditions of 23° C. and a relative humidity of 50%. A surface temperature of a metal roll of the calendering apparatus was set using a temperature setting means of the apparatus. For confirmation, the surface temperature was measured with a thermometer (Digital Thermometer Model 2455 (iuchi)) to be correct.

Examples 22 to 38 and Comparative Examples 21 to 28

Coated papers were prepared similarly as in Example 21, except that moisture contents of base papers and coated papers before calendering were changed to values shown in Table 2.

In the present invention, moisture contents of a base paper and a coated paper before calendering were measured as follows. A base paper or a coated paper before calendering is cut into a piece of 12 cm by 12 cm. The piece is placed in a 200 ml media vial, dried for 30 minutes at 105° C., sealed with a cap, and cooled to a room temperature. A moisture content of the resultant base paper or the coated paper in this state was taken as 0% by weight. The base paper or the coated paper having a moisture content of 0% by weight was conditioned for humidity under the conditions of 23° C. and a relative humidity of 65% while monitoring an increase of weight. When a moisture content reaches a desired value, the piece is subjected to the step of coating or calendering in (2). A moisture content at this time is considered as that of the base paper or the coated paper before calendering. A moisture content refers to a percentage by weight of water with respect to a weight of a coated paper.

A relationship between a linear pressure of the labo calendering apparatus and a pressure applied on a coated paper was determined by the following method. Under the conditions described above, a pressure-sensitive paper "Prescale" (Fujifilm Corporation) was passed through the labo calendering apparatus with various linear pressures. Coloring of the paper by a linear pressure was used to determine a pressure applied on the paper at the linear pressure. For measuring at a linear pressure less than 100 kg/cm, a pressure-sensitive paper for middle pressure was used, and for measuring 100 kg/cm or higher, a pressure-sensitive paper for high pressure was used. The results were as follows: a pressure of 9 MPa for a linear pressure of 21 kg/cm, 25 MPa for 42 kg/cm, 49 MPa for 200 kg/cm, 56 MPa for 250 kg/cm, and 80 MPa for 500 kg/cm.

In Examples 31, 32, 35, and 36, for producing a base paper, to an LBKP slurry was added an emulsion of 1% by weight of pentaerythritol monostearate (in Table 2, referred to as ester compound A) in an amount of effective contents as shown in Table 2 with respect to 100 parts by weight of pulp, stirred, and diluted with water such that a pulp concentration was 0.5% by weight. To this was added an aqueous solution of 0.05% by weight of polyacrylamide polymer (Ciba Specialty Chemicals, PERCOL 47) in an amount of 0.03 parts by weight with respect to 100 parts by weight of pulp, stirred, and subjected to papermaking on an 80-mesh wire with a square Tappi paper machine to produce a wet sheet. The ester compound A was used in the state of emulsion, prepared by mixing in water with a cationized starch as an emulsifier, using a homomixer (Primix Corporation, Robomix).

In Examples 33, 34, 37, and 38, an aqueous dispersant of 1% by weight of polyalkylenepolyamine-fatty acid-epichlorohydrin condensate (amide compound derivative B) prepared by the method below was used instead of pentaerythritol monostearate above in an amount of effective contents as shown in Table 2. The following operations were performed in the same way as in Example 31 to produce a wet sheet.

The amide compound derivative B was prepared in the same way as in Example 1.

In Examples 30, and 35 to 38, a base paper was prepared. An aqueous solution of 1.0% by weight of carboxymethylcellulose sodium salt (Nippon Paper Chemicals Co., Ltd, F10LC, referred to as CMC in the table) was spread over both sides of the base paper with a bar coater in such amount as that a coated amount (based on solid content) per side was a value shown in Table 2. The treated base paper was dried and used in the step of coating. More specifically, the aqueous solution of 1.0% by weight of CMC was spread over a glass plate with a bar coater (No. 14) to form a cast film on the glass plate. The base paper (width: 12 cm, length: 12 cm) was placed on the cast film, and covered with a filter paper of 100 g/m$^2$. A roll (diameter: 200 mm, width: 200 mm, linear pressure: 230 g/cm) was rolled over the paper to transfer the liquid film of the aqueous CMC solution from the glass plate to the surface of the base paper. The paper was then dried for two minutes at 105° C. with a mirror-finished dryer. These operations were quickly performed in no time between operations. The dried pulp sheet was conditioned for its humidity for one day under the conditions of 23° C. and 50% humidity. These operations were performed for both sides of the base paper.

<Evaluation>

The coated papers prepared in Examples 21 to 38 and Comparative Examples 21 to 28 were measured for density in accordance with JIS-P8118, and for white paper glossiness in accordance with JIS-P8142. A white paper glossiness was measured at both sides of paper and used to calculate an average value. Results are shown in Table 2.

TABLE 2

| | | Fiber-binding inhibitor | | Water-soluble polymer | | Moisture content (% by weight) | | | |
|---|---|---|---|---|---|---|---|---|---|
| | | Kind | Added amount (part*) | Kind | Coated amount (g/m$^2$) | Base paper | Coated paper before calendering | Density (g/cm$^3$) | 75° mirror surface glossiness (%) |
| Example | 21 | — | — | — | — | 0 | 0 | 0.94 | 39.2 |
| | 22 | — | — | — | — | 1.9 | 0 | 0.95 | 35.6 |
| | 23 | — | — | — | — | 3.8 | 1.9 | 1.00 | 40.7 |
| | 24 | — | — | — | — | 0 | 3.8 | 1.07 | 47.6 |
| | 25 | — | — | — | — | 1.9 | 3.8 | 1.08 | 47.2 |
| | 26 | — | — | — | — | 3.8 | 3.8 | 1.08 | 47.1 |
| | 27 | — | — | — | — | 0 | 4.9 | 1.15 | 56.4 |
| | 28 | — | — | — | — | 2 | 4.8 | 1.16 | 55.7 |
| | 29 | — | — | — | — | 3.8 | 4.9 | 1.16 | 55.0 |
| | 30 | — | — | CMC | 0.3 | 3.8 | 3.8 | 1.14 | 55.1 |
| | 31 | Ester compound A | 0.5 | — | — | 0 | 3.8 | 1.07 | 52.7 |
| | 32 | Ester compound A | 1.0 | — | — | 0 | 3.8 | 1.06 | 48.9 |
| | 33 | Amido compound derivative B | 0.5 | — | — | 0 | 4.9 | 1.12 | 52.5 |
| | 34 | Amido compound derivative B | 1.0 | — | — | 0 | 3.8 | 1.08 | 48.3 |
| | 35 | Ester compound A | 0.5 | CMC | 0.3 | 0 | 3.8 | 1.00 | 50.1 |
| | 36 | Ester compound A | 0.5 | CMC | 0.3 | 0 | 4.9 | 1.03 | 58.4 |
| | 37 | Amido compound derivative B | 0.5 | CMC | 0.3 | 0 | 3.8 | 1.07 | 53.0 |
| | 38 | Amido compound derivative B | 0.5 | CMC | 0.3 | 0 | 4.9 | 1.11 | 58.6 |

TABLE 2-continued

| | | Fiber-binding inhibitor | | Water-soluble polymer | | Moisture content (% by weight) | | | |
|---|---|---|---|---|---|---|---|---|---|
| | | Kind | Added amount (part*) | Kind | Coated amount ($g/m^2$) | Base paper | Coated paper before calendering | Density ($g/cm^3$) | 75° mirror surface glossiness (%) |
| Comparative example | 21 | — | — | — | — | 7 | 6 | 1.20 | 55.8 |
| | 22 | — | — | — | — | 5 | 4.9 | 1.15 | 51.2 |
| | 23 | — | — | — | — | 7 | 4.9 | 1.14 | 51.4 |
| | 24 | — | — | — | — | 5 | 3.8 | 1.08 | 42.9 |
| | 25 | — | — | — | — | 7 | 3.8 | 1.08 | 42.7 |
| | 26 | — | — | — | — | 5 | 0 | 0.92 | 32.7 |
| | 27 | — | — | — | — | 7 | 0 | 0.94 | 32.8 |
| | 28 | — | — | — | — | 3.8 | 6 | 1.20 | 59.8 |

Figure 2:
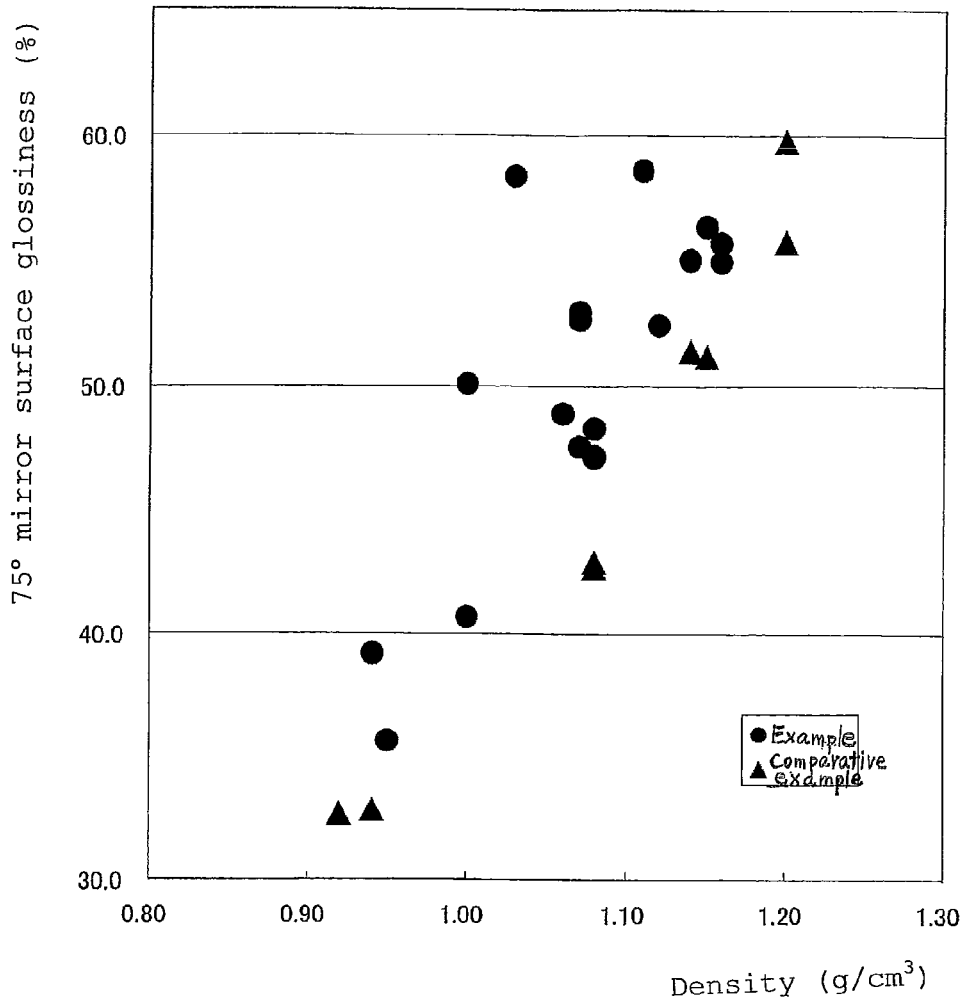
FIG. 2 is a graph showing a relationship between density and 75° mirror surface glossiness of each coated paper obtained in Examples and Comparative Examples of Invention II.

*Parts by weight with respect to 100 parts by weight of pulp based on solid content FIG. 2 collectively shows respective relations between density and 75° mirror surface glossiness of Examples and Comparative Examples based on results in Table 2. From Table 2 and FIG. 2, it can be seen that Examples have higher glossiness than that of Comparative Examples having almost the same densities, and lower densities than that of Comparative Examples having similar glossinesses, and therefore, the present invention achieves both low density and high glossiness.

The invention claimed is:

1. A method for producing a coated paper, comprising steps of:

coating a base paper with a coating liquid comprising at least a pigment and an adhesive to produce a coated paper; and calendering the coated paper, wherein the base paper is coated with an aqueous solution of a water-soluble polymer, and the step of calendering is a step of calendering the coated paper having a moisture content of 0 to 2% by weight; and wherein the water-soluble polymer is at least one compound selected from the group consisting of cellulose compounds, and cationic group-containing vinyl copolymers produced by copolymerizing monomers comprising a cationic group-containing vinyl monomer and a hydrophilic nonionic group-containing vinyl monomer.

2. The method for producing a coated paper according to claim 1, wherein the base paper is prepared by adding a fiber-binding inhibitor to a pulp slurry and papermaking.

3. The method for producing a coated paper according to claim 2, wherein the fiber-binding inhibitor is at least one compound selected from the group consisting of ester compounds and derivatives thereof, and amide compounds and derivatives thereof.

4. The method for producing a coated paper according claim 1, further comprising a step of conditioning a humidity of the coated paper to increase a moisture content after the step of calendering.

* * * * *